US008128488B2

(12) United States Patent
Gomez et al.

(10) Patent No.: US 8,128,488 B2
(45) Date of Patent: Mar. 6, 2012

(54) GAMING MACHINE WITH REPEATED AWARD FEATURE

(75) Inventors: Benjamin T. Gomez, Chicago, IL (US); Alfred Thomas, Las Vegas, NV (US); Joel R. Jaffe, Glenview, IL (US)

(73) Assignee: WMS Gaming Inc., Waukegan, IL (US)

( * ) Notice: Subject to any disclaimer, the term of this patent is extended or adjusted under 35 U.S.C. 154(b) by 869 days.

(21) Appl. No.: 11/919,361

(22) PCT Filed: Apr. 26, 2006

(86) PCT No.: PCT/US2006/015674

§ 371 (c)(1), (2), (4) Date: Oct. 25, 2007

(87) PCT Pub. No.: WO2006/116426

PCT Pub. Date: Nov. 2, 2006

(65) Prior Publication Data

US 2010/0075745 A1 Mar. 25, 2010

Related U.S. Application Data

(60) Provisional application No. 60/675,151, filed on Apr. 27, 2005.

(51) Int. Cl.
*A63F 9/24* (2006.01)

(52) U.S. Cl. ..... 463/25; 463/16; 463/20

(58) Field of Classification Search ..... 463/16, 463/20, 25–30

See application file for complete search history.

(56) References Cited

U.S. PATENT DOCUMENTS 2,026,082 A 12/1935 Darrow ..... 273/256

(Continued)

OTHER PUBLICATIONS

Monopoly™ Parker Brothers Real Estate Trading Game, rules, pp. 1-6, downloaded from www.parkerbrothers.com, Aug. 24, 2006, copyright 1935-1997, see entire document.

(Continued)

*Primary Examiner* — Masud Ahmed
(74) *Attorney, Agent, or Firm* — Nixon Peabody LLP

(57) ABSTRACT

A gaming system for conducting a wagering game comprises a value input device for receiving a wager to play the wagering game, a display for displaying a plurality of selectable elements, and a controller coupled to the display. The controller is operative to designate at least one of the selectable elements as a rental element and repeat an award associated with the rental element as other ones of the selectable elements are successively selected. Methods for conducting a wagering game are also disclosed.

20 Claims, 10 Drawing Sheets

U.S. PATENT DOCUMENTS

| | | | | |
|---|---|---|---|---|
| 6,769,983 | B2 * | 8/2004 | Slomiany | 463/16 |
| 6,848,996 | B2 * | 2/2005 | Hecht et al. | 463/35 |
| 7,316,609 | B2 * | 1/2008 | Dunn et al. | 463/16 |
| 7,566,271 | B2 * | 7/2009 | Hostetler et al. | 463/25 |
| 7,601,058 | B2 * | 10/2009 | Slomiany | 463/16 |
| 7,785,188 | B2 * | 8/2010 | Cannon | 463/20 |
| 2003/0087687 | A1 * | 5/2003 | Locke et al. | 463/20 |
| 2003/0199308 | A1 * | 10/2003 | Parker | 463/20 |
| 2003/0216169 | A1 * | 11/2003 | Walker et al. | 463/25 |
| 2004/0176156 | A1 * | 9/2004 | Walker et al. | 463/16 |
| 2004/0214628 | A1 * | 10/2004 | Boyd et al. | 463/20 |
| 2004/0248642 | A1 * | 12/2004 | Rothschild | 463/20 |
| 2004/0266507 | A1 * | 12/2004 | Cooper | 463/13 |
| 2005/0014554 | A1 | 1/2005 | Walker et al. | 463/20 |
| 2005/0054416 | A1 * | 3/2005 | Hostetler et al. | 463/16 |
| 2005/0054434 | A1 * | 3/2005 | Baerlocher et al. | 463/25 |
| 2005/0130731 | A1 * | 6/2005 | Englman et al. | 463/20 |
| 2005/0130737 | A1 * | 6/2005 | Englman et al. | 463/25 |

OTHER PUBLICATIONS

International Search Report corresponding to International Patent Application No. PCT/US2006/015674, ISA/US, dated Oct. 4, 2006, 3 pages.

* cited by examiner

GAMING MACHINE WITH REPEATED AWARD FEATURE

CROSS-REFERENCE TO RELATED APPLICATIONS

This application is a U.S. national phase of International Application No. PCT/US2006/015674, filed Apr. 26, 2006, which claims the benefit of priority of U.S. Provisional Patent Application No. 60/675,151, filed Apr. 27, 2005, both of which are incorporated by reference in their entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to a gaining machine having a repeated award feature.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaining enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming machines with new types of bonus games to satisfy the demands of players and operators.

SUMMARY OF THE INVENTION

According to one aspect of the present invention, a gaming system for conducting a wagering game includes a value input device for receiving a wager to play the wagering game, a display for displaying a plurality of selectable elements, and a controller coupled to the display. The controller is operative to designate at least one of the selectable elements as a rental element and repeat an award associated with the rental element as other ones of the selectable elements are successively selected.

According to another aspect of the invention, a method of conducting a wagering game on a gaming system comprises receiving a wager to play the wagering game, displaying a plurality of selectable elements, designating at least one of the selectable elements as a rental element, and repeating an award associated with the rental element as other ones of the selectable elements are successively selected.

According to another aspect of the invention, a method of conducting a wagering game on a gaming system comprises receiving a wager to play the wagering game, displaying a plurality of selectable elements. The plurality of selectable elements comprises a first set of selectable elements and a second set of selectable elements. The first set of selectable elements comprising at least one rental element associated with an award. The method further comprises repeating an award associated with the rental element as other ones of the selectable elements in at least the second set of selectable elements are successively selected.

According to yet another aspect of the invention, a computer readable storage medium is encoded with instructions for directing a gaming system to perform the above methods.

Additional aspects of the invention will be apparent to those of ordinary skill in the art in view of the detailed description of various embodiments, which is made with reference to the drawings, a brief description of which is provided below.

DETAILED DESCRIPTION

Figure 1:
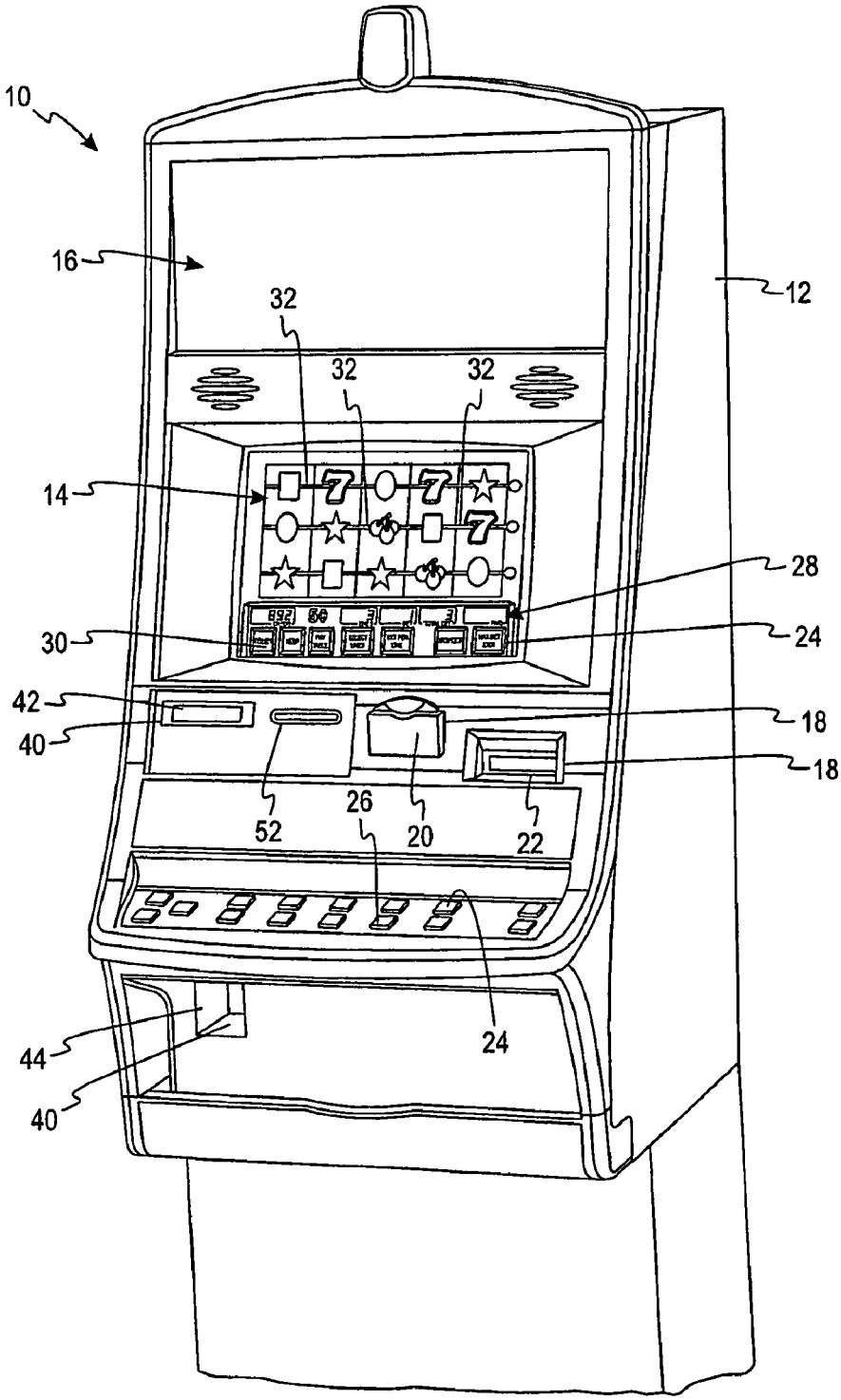
FIG. 1 is a perspective view of a gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire monitor (or a portion thereof) to allow players to make game-related selections. Alternatively, the primary display 14 of the gaming machine 10 may include a number of mechanical reels to display the outcome in visual associated to at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1 as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 2:
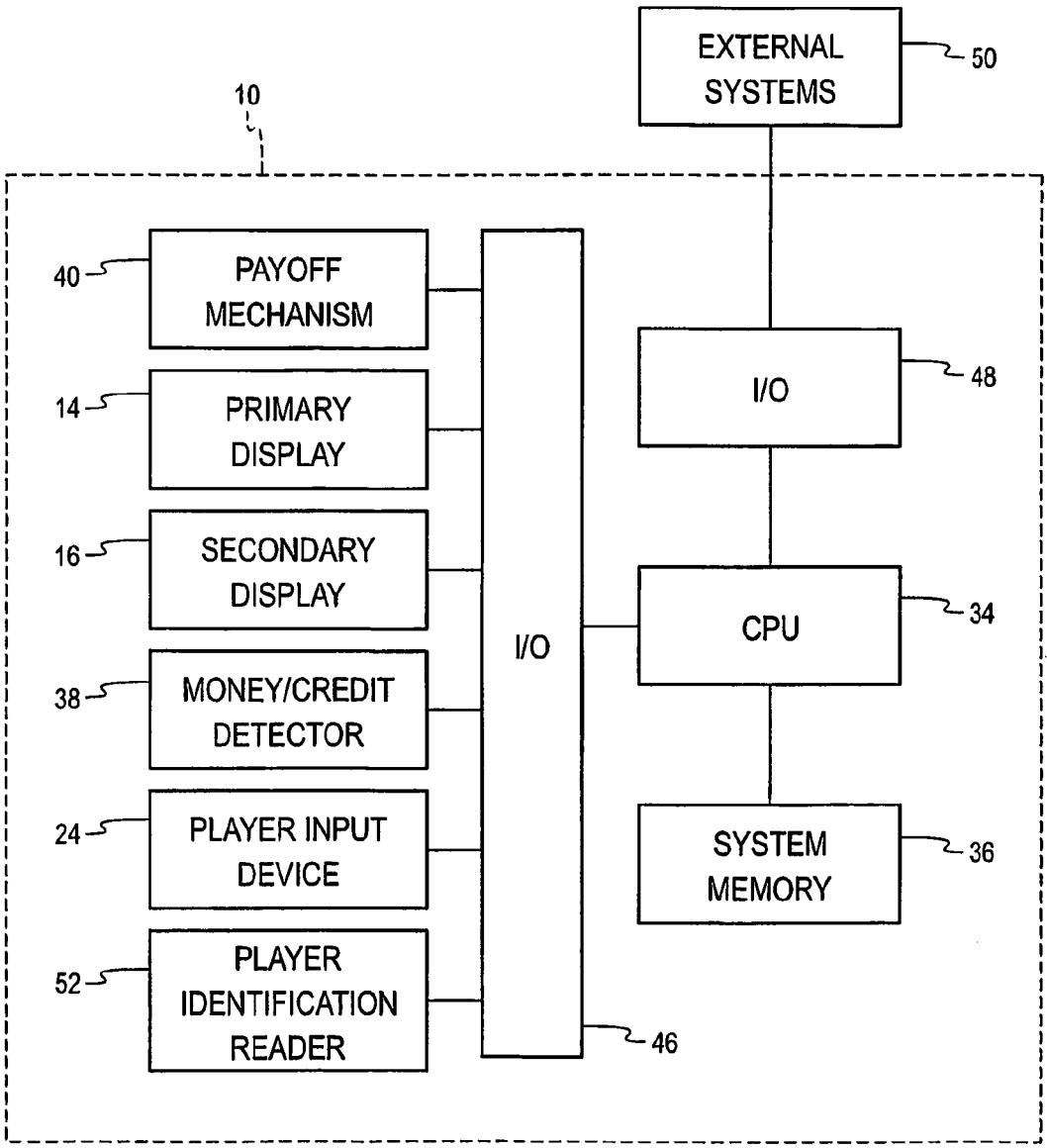
FIG. 2 is a block diagram of a control system suitable for operating a gaming machine in accord with the present concepts.

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36.

Figure 3:
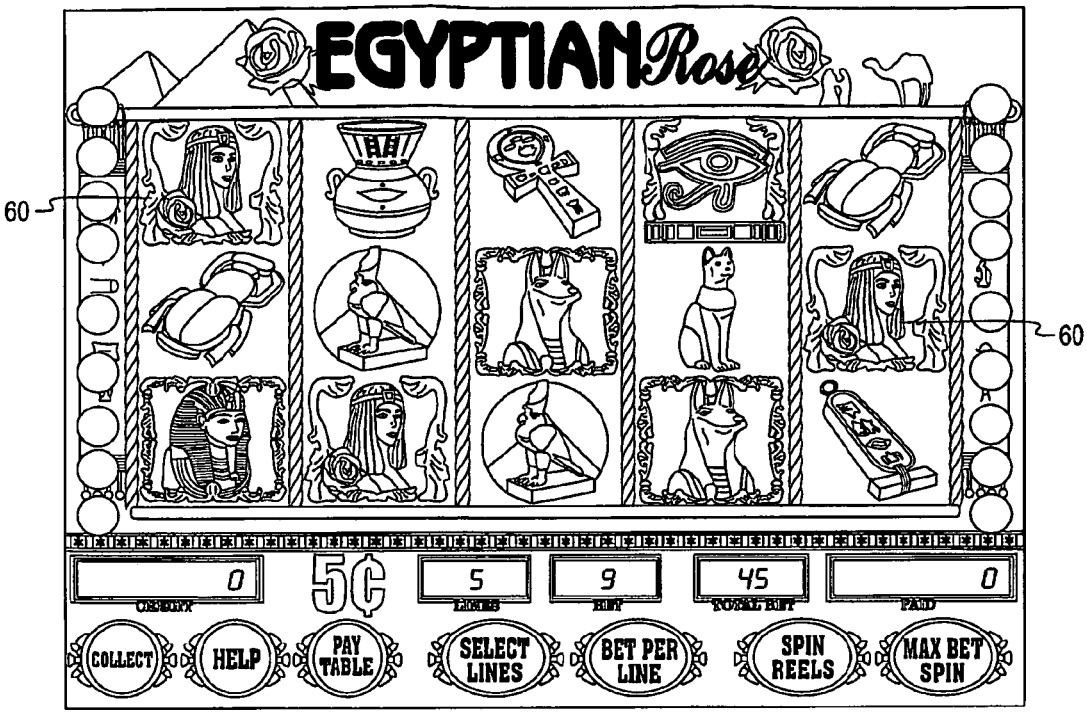
FIG. 3 is a representation of a screen display associated with a start-bonus outcome in a base slot game according to at least some aspects of the present concepts.

Turning now to FIG. 3, a pair of scattered Egyptian Rose symbols 60 on the first and fifth reels trigger a bonus feature called the "Treasure Bonus." However, other methods of triggering the bonus feature are contemplated as falling within the present invention. For example, the bonus feature may be triggered by any single symbol on a single reel or any combination of symbols on more than one reel and may optionally be contingent upon or influenced by a wager, game-related variables or non-game-related variables.

Figure 4:
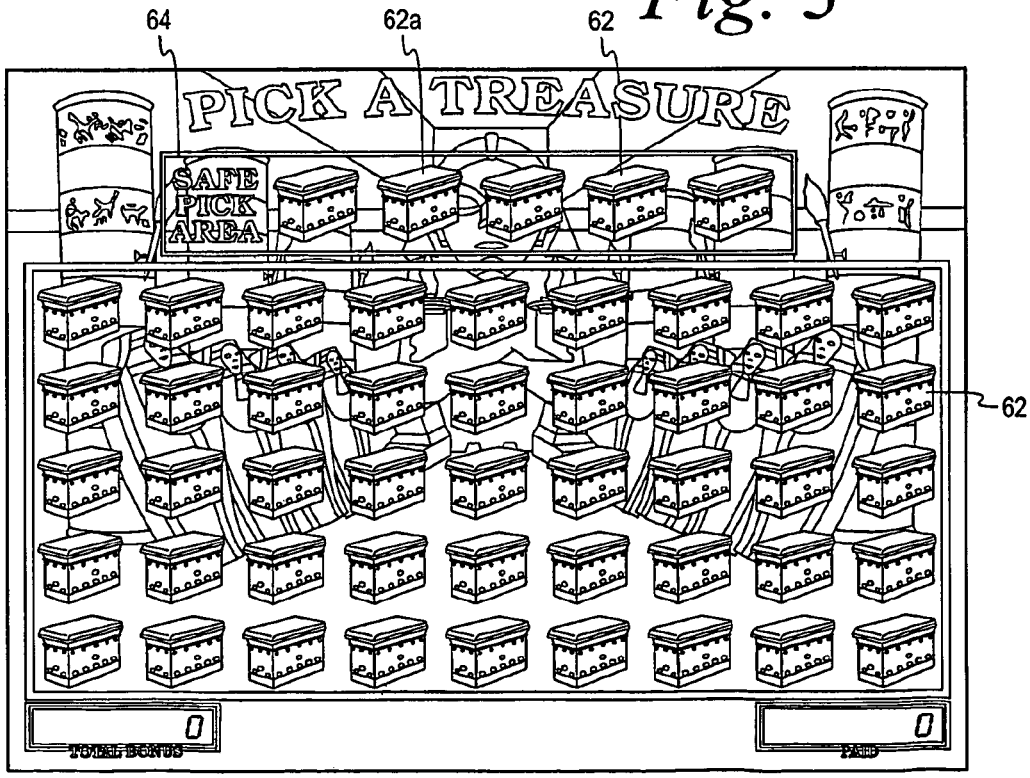
FIGS. 4 through 15 are representations of a screen displays associated with a bonus game triggered by a start-bonus outcome according to at least some aspects of the present concepts.

Referring to FIG. 4, in the bonus feature the player first selects a selectable element (e.g., treasure ark 62*a*) from a plurality of selectable elements (e.g., treasure arks 62) in a first selection area (e.g., safe area 64). The treasure arks 62 in the safe area 64 only contain awards or beneficial outcomes, such as credit values or multipliers, and do not contain any bonus ending items. It should be noted that other themed games may use other elements than those described and illustrated herein.

Figure 5:
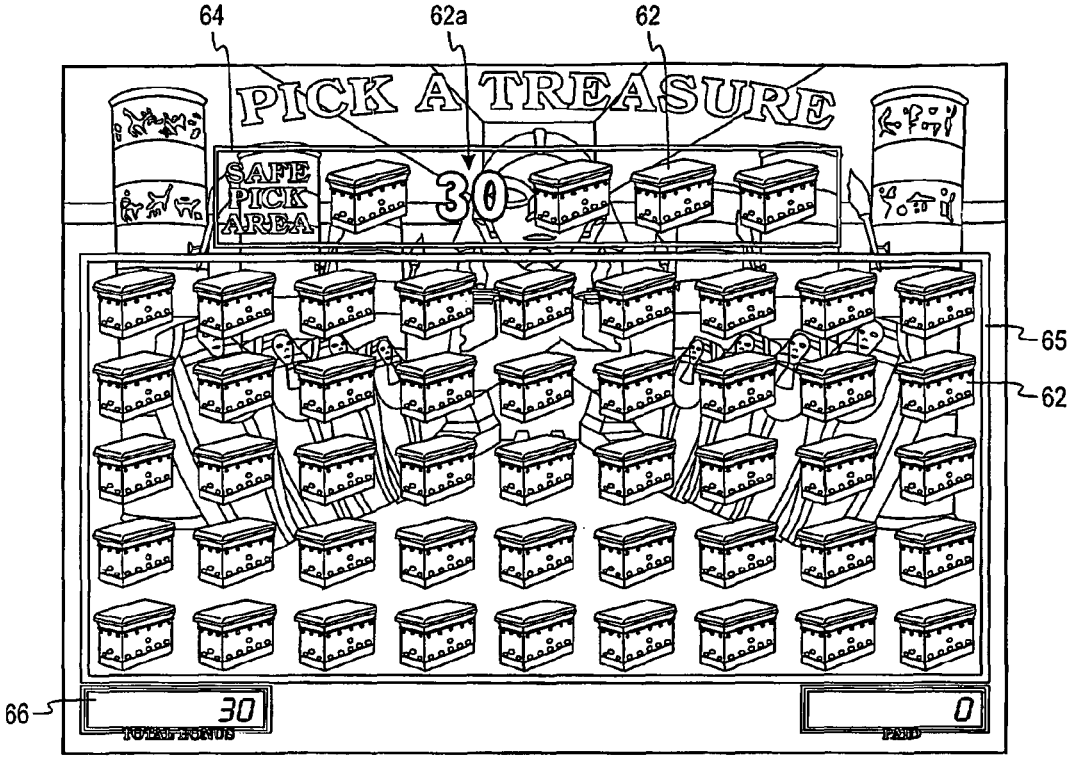

Referring now to FIG. 5, the selected treasure ark 62*a* reveals a credit amount which, in the illustrated example, is 30 credits. This credit amount is added to a total bonus meter 66. Alternatively, the safe pick credit amount is not added to the bonus meter 66 when initially selected, but rather is only added to the bonus meter 66 in conjunction with selections made from a second selection area 65 outside the safe area 64. After the player makes the selection from the safe area 64, the player is done picking from the safe area 64 and proceeds to select from treasure arks 62 in the second area 65 outside the safe area 64.

Figure 6:
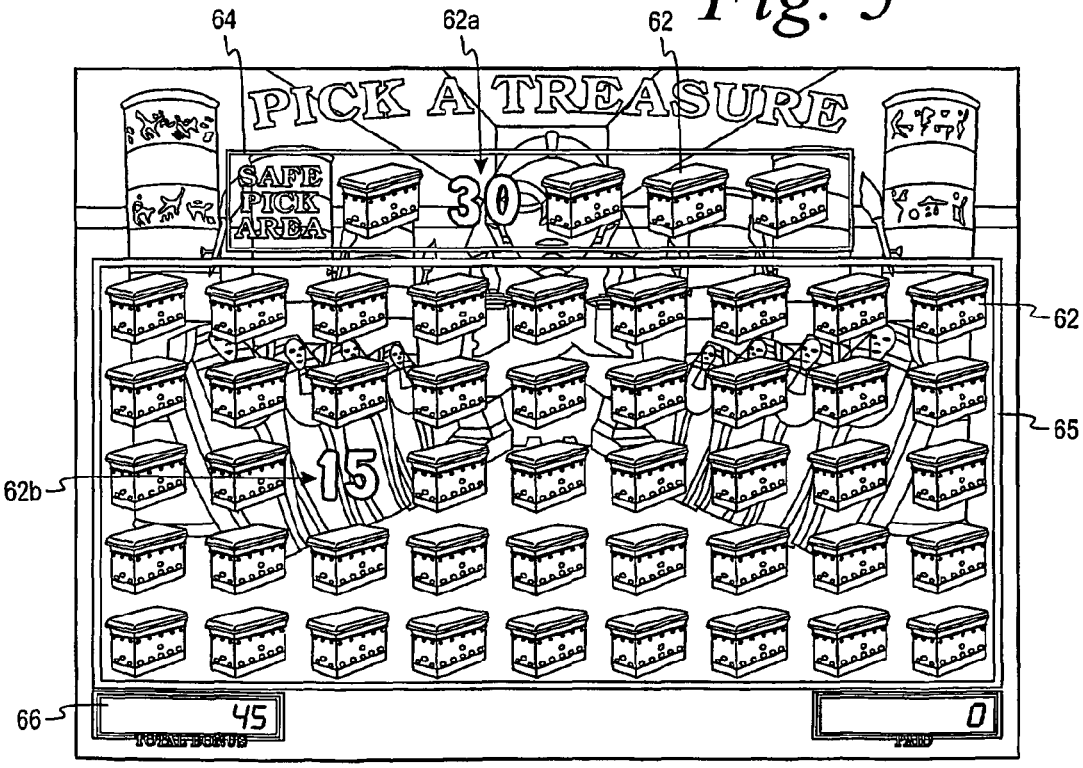
Figure 7:
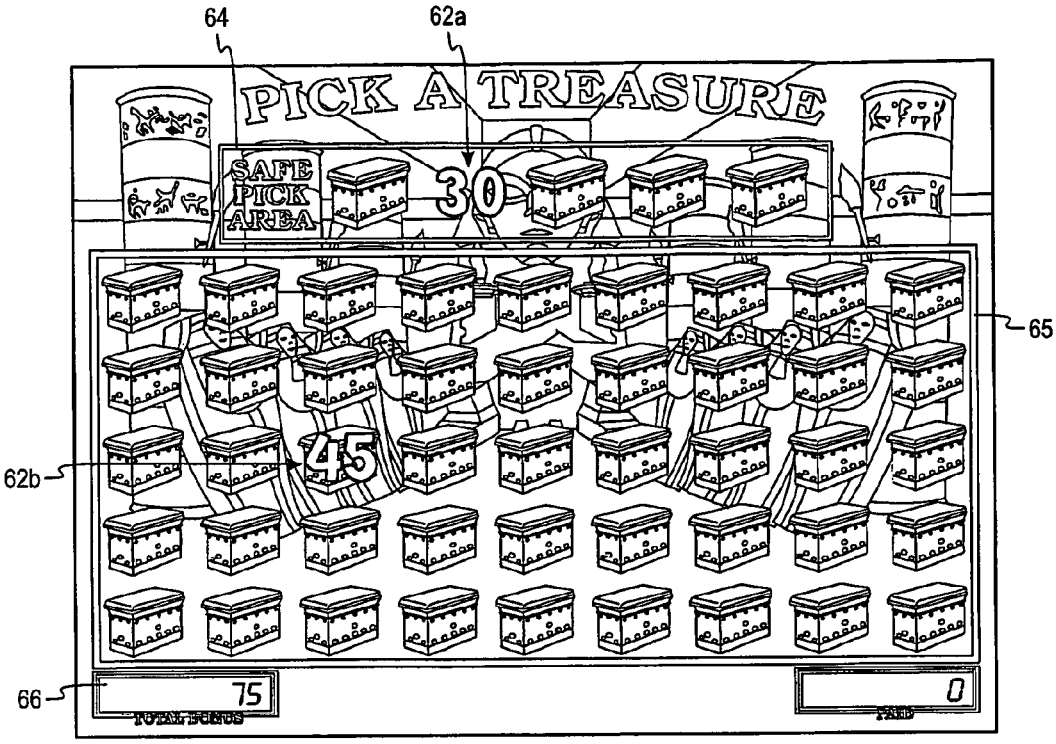
Figure 8:
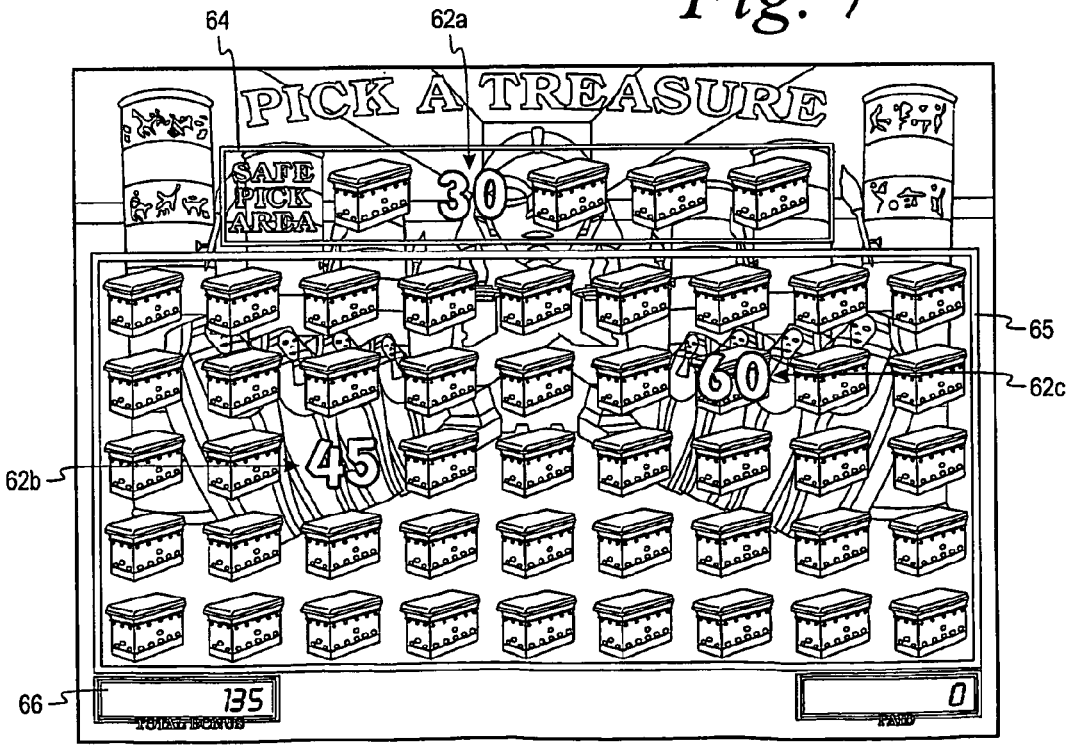

Referring to FIG. 6, each treasure ark 62 in the second area 65 is associated with a credit amount, a "Collect" or other end-feature symbol, a "Safe Pick Again," a multiplier element, or a shield. Other outcomes are optionally available. Whenever a selection reveals a credit amount, the credit amount of the selected safe area pick 62*a* is added to the revealed credit amount. In the illustrated example, the player first selects in the second area 65 a treasure ark 62*b* worth 15 credits, and the safe pick credit amount of 30 credits is added thereto to yield a total credit amount of 45 credits, as shown in FIG. 7. As also shown in FIG. 7, this total credit amount of 45 credits, shown at a location of the selected treasure ark 62*b*, is added to the bonus meter 66, shown with the updated total bonus of 75 credits. Referring to FIG. 8, the player then picks a treasure ark 62*c* associated with a value of 30 credits, and the safe pick credit amount of 30 credits is added to yield a total credit amount of 60 credits, as shown. This total credit amount of 60 credits, shown at a location of the selected treasure ark 62*c*, is also added thereto to the bonus meter 66 to yield a total bonus of 135 credits.

Figure 9:
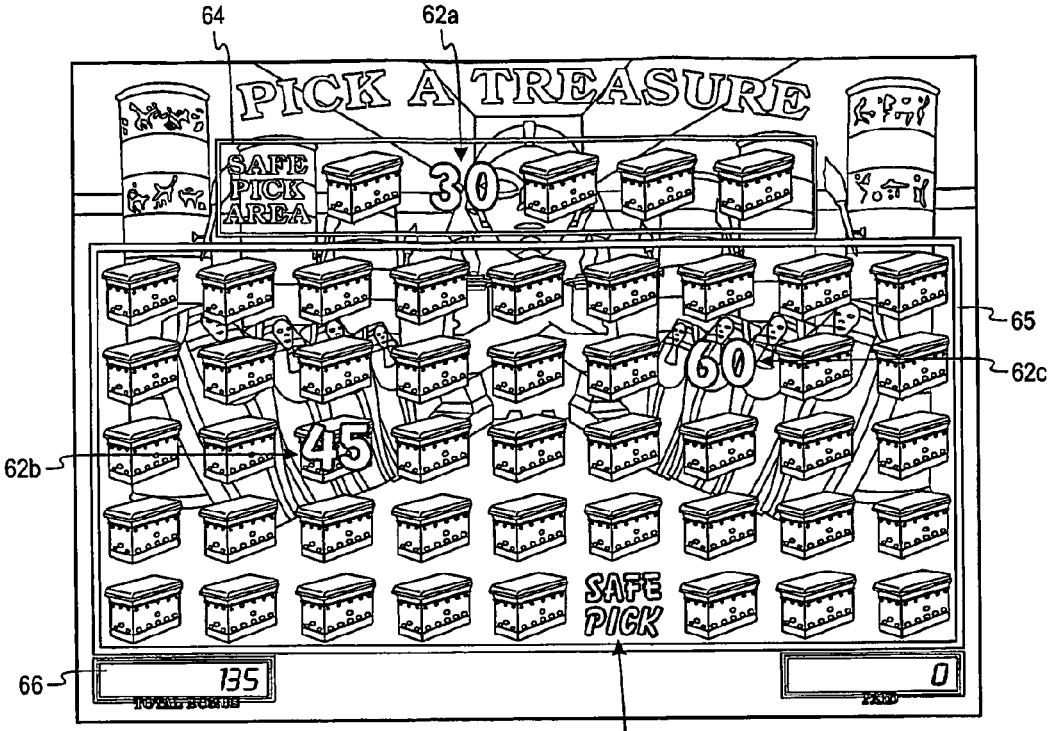
Figure 10:
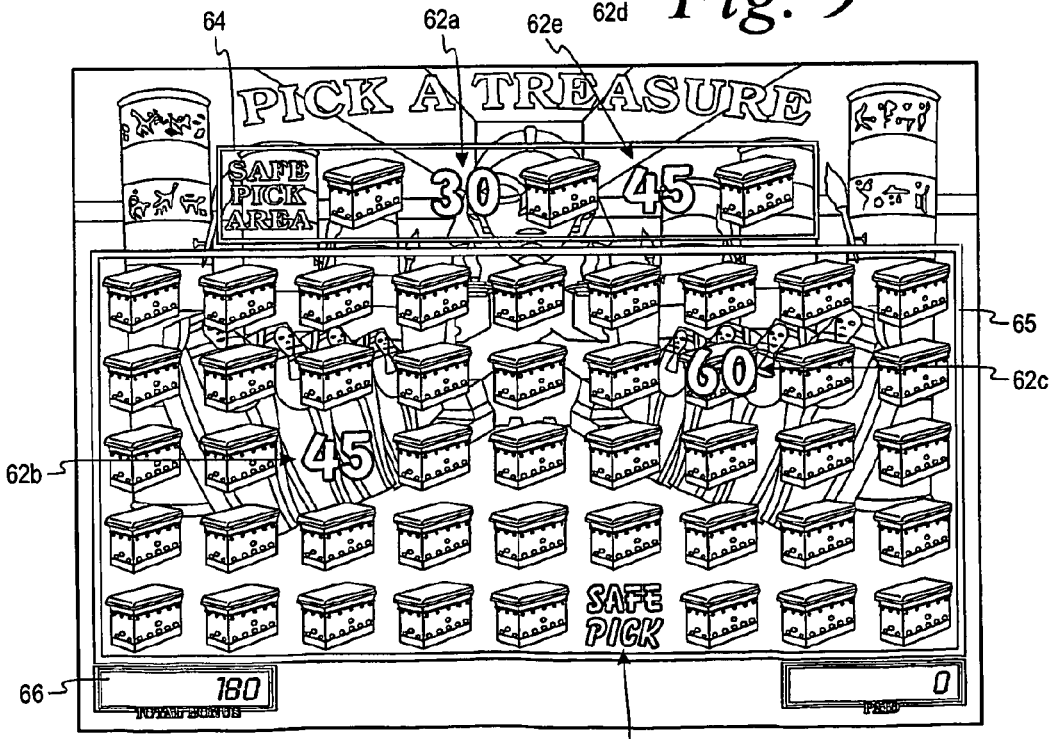

Referring to FIG. 9, if the player selects a treasure ark 62*d* that reveals "Safe Pick Again," the player is awarded another selection from the remaining treasure arks 62 in the safe pick area 64. Referring to FIG. 10, the player selects a treasure ark 62*e* in the safe pick area 64 to reveal a credit amount which, in the illustrated example, is 45 credits. This credit amount is added to the bonus meter 66 to yield a total bonus of 180 credits. Alternatively, the safe pick credit amount is not added to the bonus meter 66 when initially selected, but rather is only added to the bonus meter 66 in conjunction with selections made from a second selection area 65 outside the safe area 64. Also, this credit amount is added to any prior safe pick credit amounts to yield an updated safe pick credit amount which, in turn, is added to any subsequent credit amounts revealed in the second area 65. That is, every time a subsequent selection in the second area 65 reveals a credit amount, the updated safe pick credit amount will be added to that credit amount. In the illustrated example, the updated safe pick credit amount is 75 credits (i.e., the sum of 30 credits and 45 credits) based on the selections of treasure arks 62*a*, 62*d*.

Figure 11:
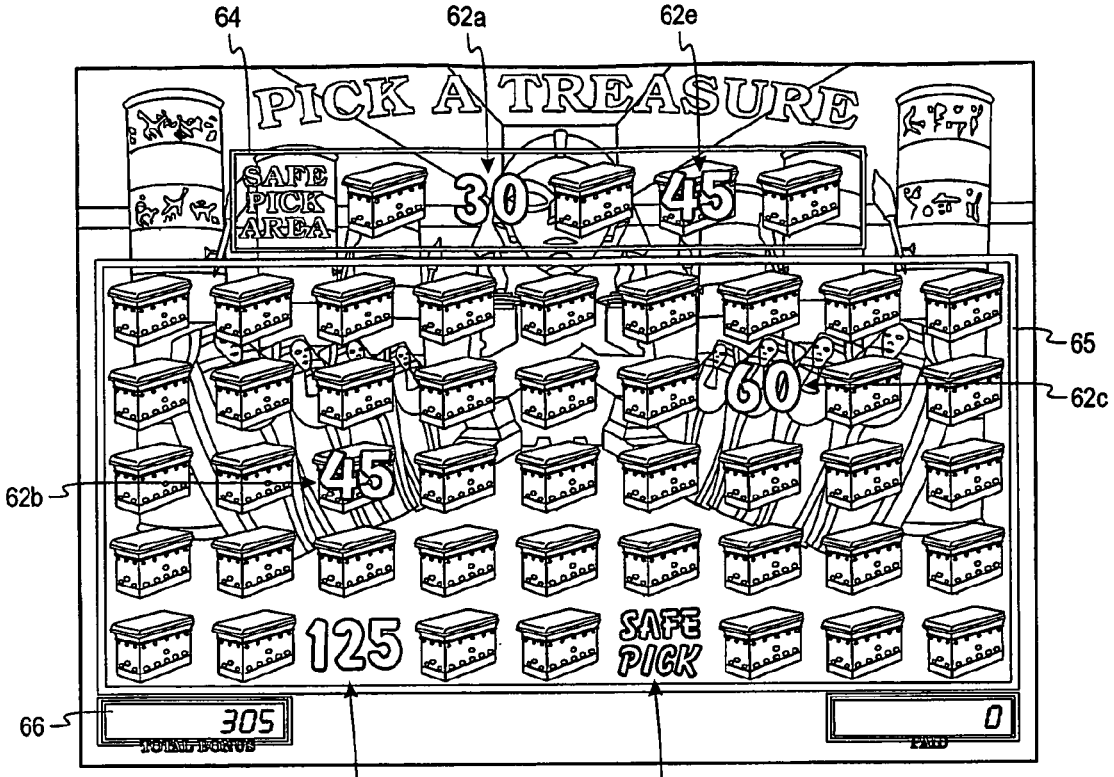

Referring to FIG. 11, the player then picks a treasure ark 62*f* worth 50 credits, and the updated safe pick credit amount of 75 credits is added thereto to yield a total credit amount of 125 credits. This total credit amount is shown at a location of the selected treasure ark 62*f* and is added to the bonus meter 66 to yield a total bonus of 305 credits, as shown.

Figure 12:
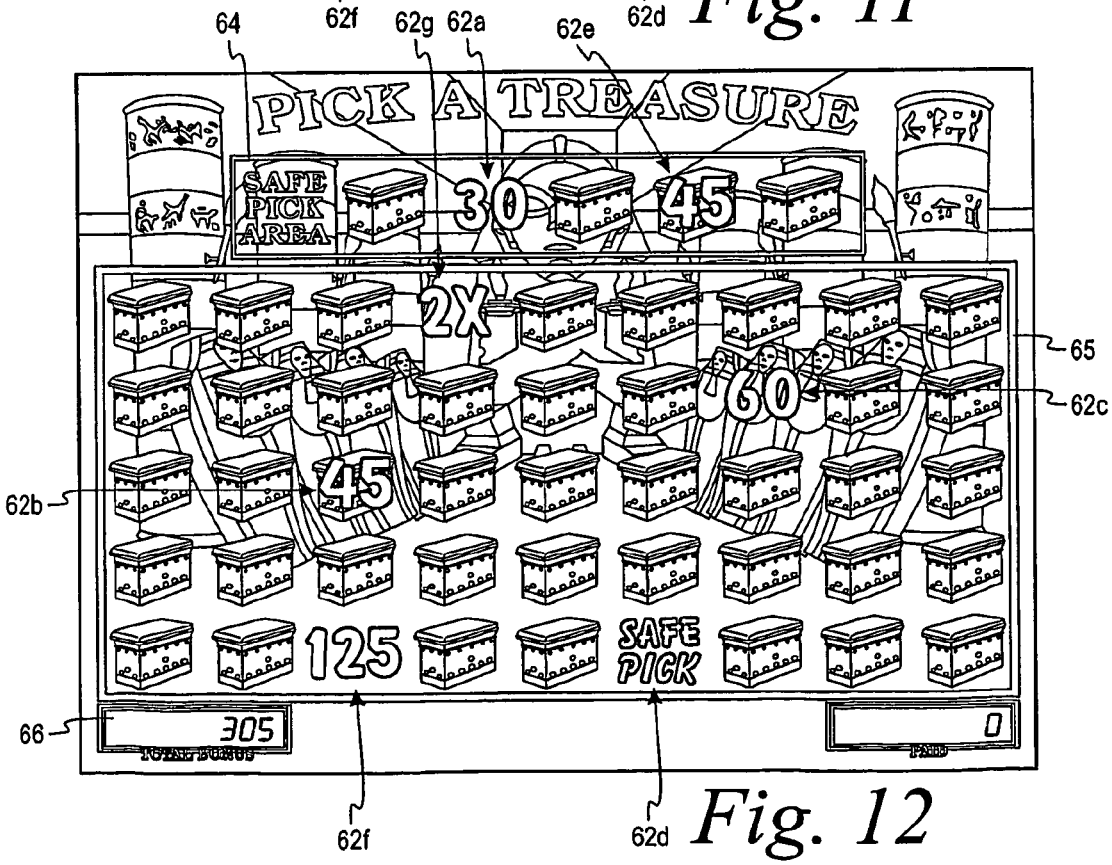
Figure 13:
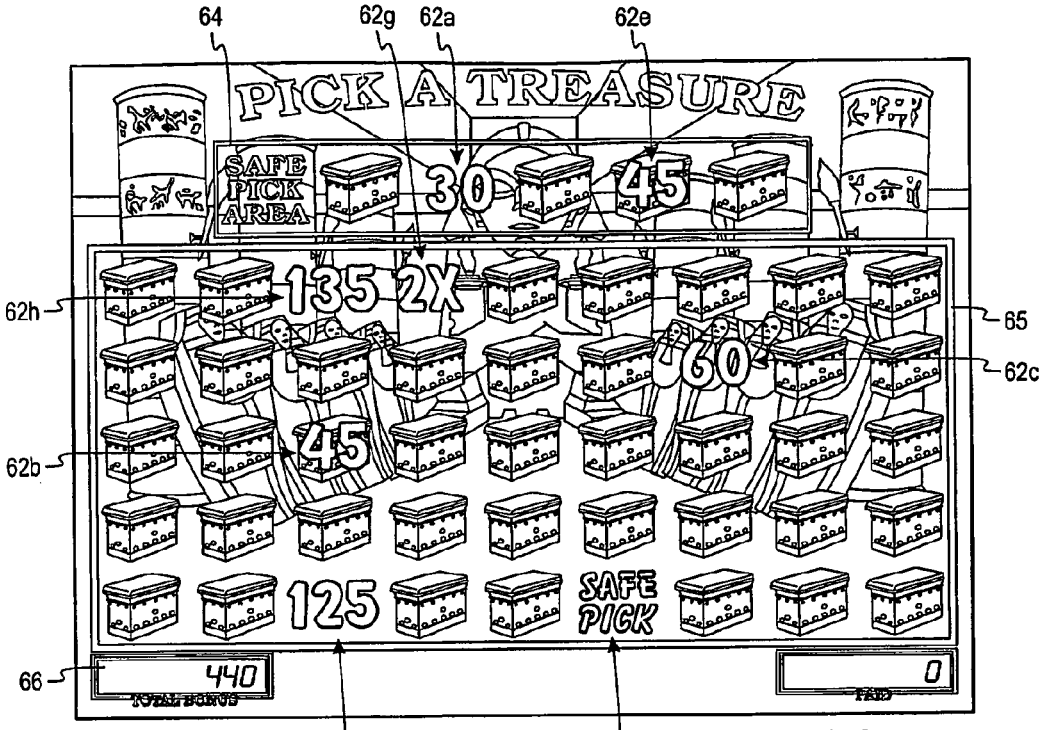

Referring to FIG. 12, the player selects a treasure ark 62*g* that reveals a multiplier element. In this case, the revealed multiplier element is "2×." However, other integer or noninteger multiplier elements may be used (e.g., 3×, 4×, 5×, 25×, n×). If the selection of the treasure ark reveals 62 a multiplier element, such as the selection of treasure ark 62*g*, the next treasure ark selected that reveals a credit value will be multiplied by the number displayed (e.g., "2"). Accordingly, if the player subsequently selects another treasure ark 62*h* initially worth 30 credits, the 30 credits is multiplied by 2, to yield 60 credits, which is then added to the safe pick credit amount of 75 credits to yield a total amount of 135 credits. This total credit amount of 135 credits is shown, for example in FIG. 13, at the location of the treasure ark 62*h*. This total credit amount of 135 credits is then added to the bonus meter 66 to yield a total bonus of 440. In accord with at least some aspects, the multiplier element is only applied to the next selection of a treasure ark 62. However, in some other embodiments, the multiplier element may be applied to every subsequently selected treasure ark 62 revealing a credit value and/or multiplier. In any of these or other aspects, the multiplier element may optionally be applied to a subsequent pick in the safe area 64. For example, if the next treasure ark 62 pick or a subsequent treasure ark 62 pick, depending on the embodiment, is a "Safe Pick Again" symbol, the treasure arks 62 in the safe area 64 selected may be multiplied by the multiplier element. Typically, the "collect" symbol will end the bonus feature. However, in at least some embodiments, the multiplier element may also function as a shield against a "collect" symbol. Thus, if the next treasure ark 62 (see, e.g., FIG. 15) selected after a multiplier element is a "collect" symbol, it is ignored and the game continues. In such embodiments, the "collect" symbol may, however nullify or diminish the multiplier element for subsequent play.

As discussed with respect to the embodiments above, the multiplier element is applied to the next and/or subsequently selected treasure arks 62. In still other embodiments, the multiplier is immediately applied to a safe pick credit amount, the product of which is added to the total bonus. In yet another embodiment, the multiplier element is applied to the safe pick credit amount to yield an updated safe pick credit amount (e.g., 2×30=60 credits).

Figure 14:
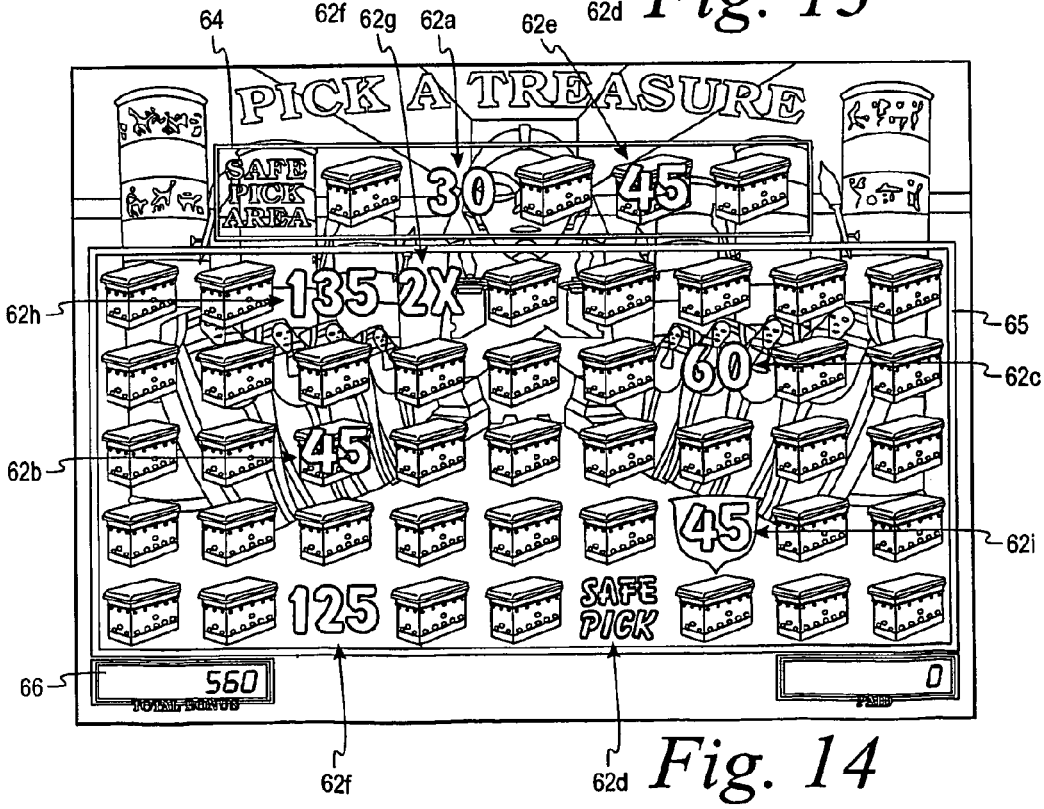

In FIG. 14, the player's selection of the depicted treasure ark 62*i* reveals a shield element. The shield symbol will nullify a "collect" symbol revealed by a subsequent selection of a treasure ark 62. The shield symbol may appear in the safe area 64 or the second area 65 and may or may not be associated with a credit amount. In FIG. 14, the shield symbol 62*i* is optionally associated with a credit value of 45 credits, but could alternatively be associated with no value or any other desired credit value. Accordingly, the 75 credits from the safe area 64 is added to the 45 credits revealed in the shield 62*i* resulting in a total amount of 120 credits. This credit amount is then added to the bonus meter 66 to yield a total bonus of 560.

Figure 15:
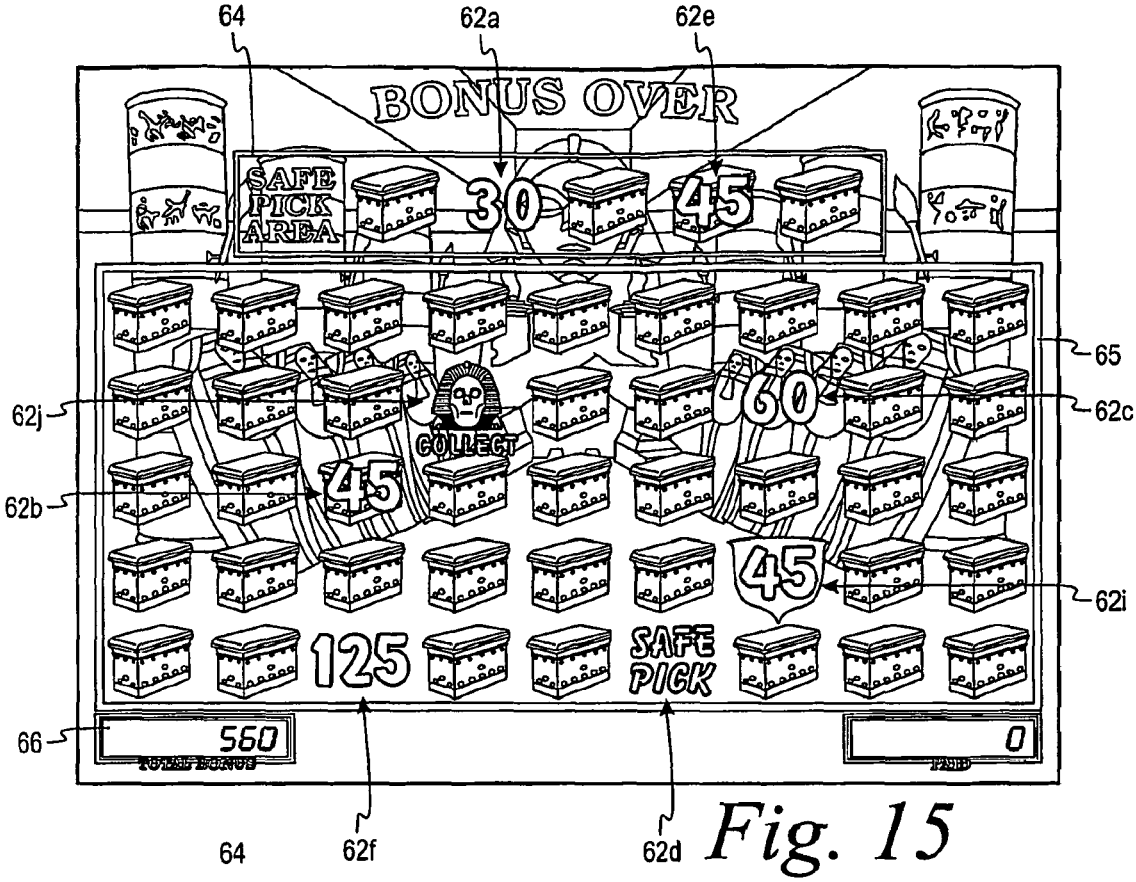
Figure 16:
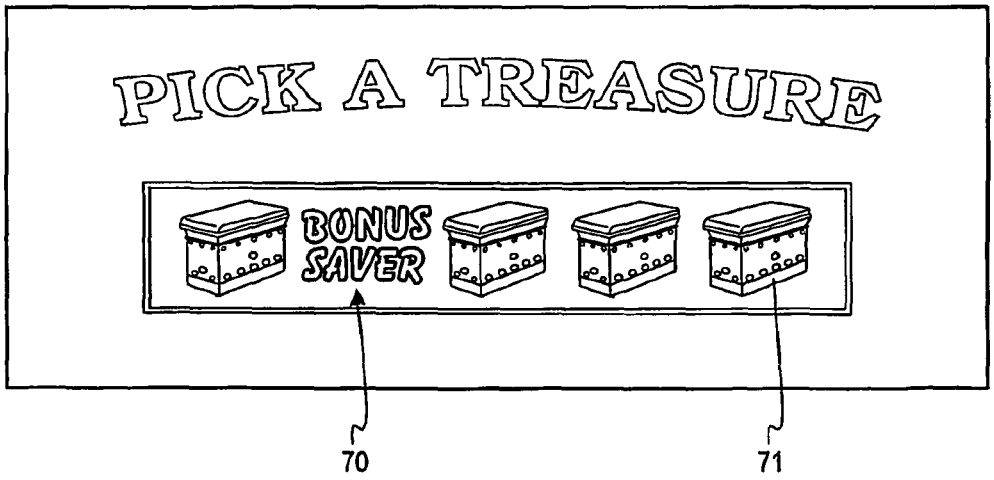
FIG. 16 is a representation of a screen display associated with a bonus saver feature triggered by an end-feature outcome in a bonus game according to at least some aspects of the present concepts.

Referring to FIG. 15, the player continues selecting treasure arks 62 until a selection reveals a non-nullified "collect" symbol 62*j* (i.e., not overridden by a prior shield symbol), which ends the bonus feature. In at least some embodiments, the player may be presented with an opportunity to return to the bonus game after a "collect" symbol is selected. As is shown by way of example in FIG. 16, following selection of treasure ark 62 revealing a "collect" symbol (e.g., 62*j*), the player is optionally directed to another screen, wherein the player is provided an opportunity to return to the bonus feature. In FIG. 16, the player has been provided an opportunity to select an element 71 from among a plurality of selectable elements and has selected an element to reveal a "bonus saver" symbol 70. The "bonus saver" outcome 70 returns the player to the bonus feature and permits continued play of the aforementioned bonus game. One or more "bonus saver" symbols 70 may be provided among the plurality of selectable elements 71 and the number of "bonus saver" symbols/outcomes may optionally be influenced or determined by wagering or non-wagering inputs during a preceding wagering game play and/or bonus game. Moreover, the number of selectable elements 71 can be varied (e.g., relative to the number of "bonus saver" symbols 70) to alter the odds of a selection of the "bonus saver" symbols/outcomes.

It can be seen from the above description that a selected element 62 in the safe area 64 pays more than once as the bonus feature continues, provided a player's first selection of a selectable element 62 is not associated with a "collect" symbol. The player essentially earns or accrues "rent" on that element (e.g., 62*a*) as other elements 62 (e.g., 62*b-c*) are subsequently selected. The rental value is preferably attached to, or added onto, the awards associated with the subsequently selected elements 62, such as shown in the example above, but may also be applied to previously selected elements in a retroactive manner. For example, the 45 credit value of the safe pick 62*e* in FIG. 10 may be added to both prior selections (e.g., 62*b-c*) and subsequent selections (e.g., 62*f-i*) in the second area 65.

In an alternative embodiment, the "rental" element is not located in a separate selectable group (e.g., safe area 64), but rather is mixed in with all the selectable elements 62 in one large group (e.g., the second area 65). In this case, every selected element 62 may accrue rent as subsequent elements are selected until the end of the bonus feature.

In yet another alternative embodiment, the "rental" elements are not located in a separate selectable group (e.g., safe area 64), but rather are randomly dispersed within the selectable elements 62 in one large group (e.g., the second area 65). In this case, the "rental" elements may be randomly selected by a player, as any of the other selectable elements. In this embodiment, the "safe pick" symbol is optionally provided. If provided, the selection of a selectable element 62 associated with the "safe pick" symbol may cause the controller 34 to highlight those selectable elements 62 associated with a "rental" element, to enable a player's identification and selection of such elements. Following a player's selection, the controller 34 is configured to optionally randomly shuffle or rearrange the remaining selectable elements 62.

In still another embodiment, the controller 34 selects the rental element(s), while the player selects the other selectable elements 62. In another embodiment, the controller 34 selects both the rental element(s) and other selectable elements 62.

Figure 17:
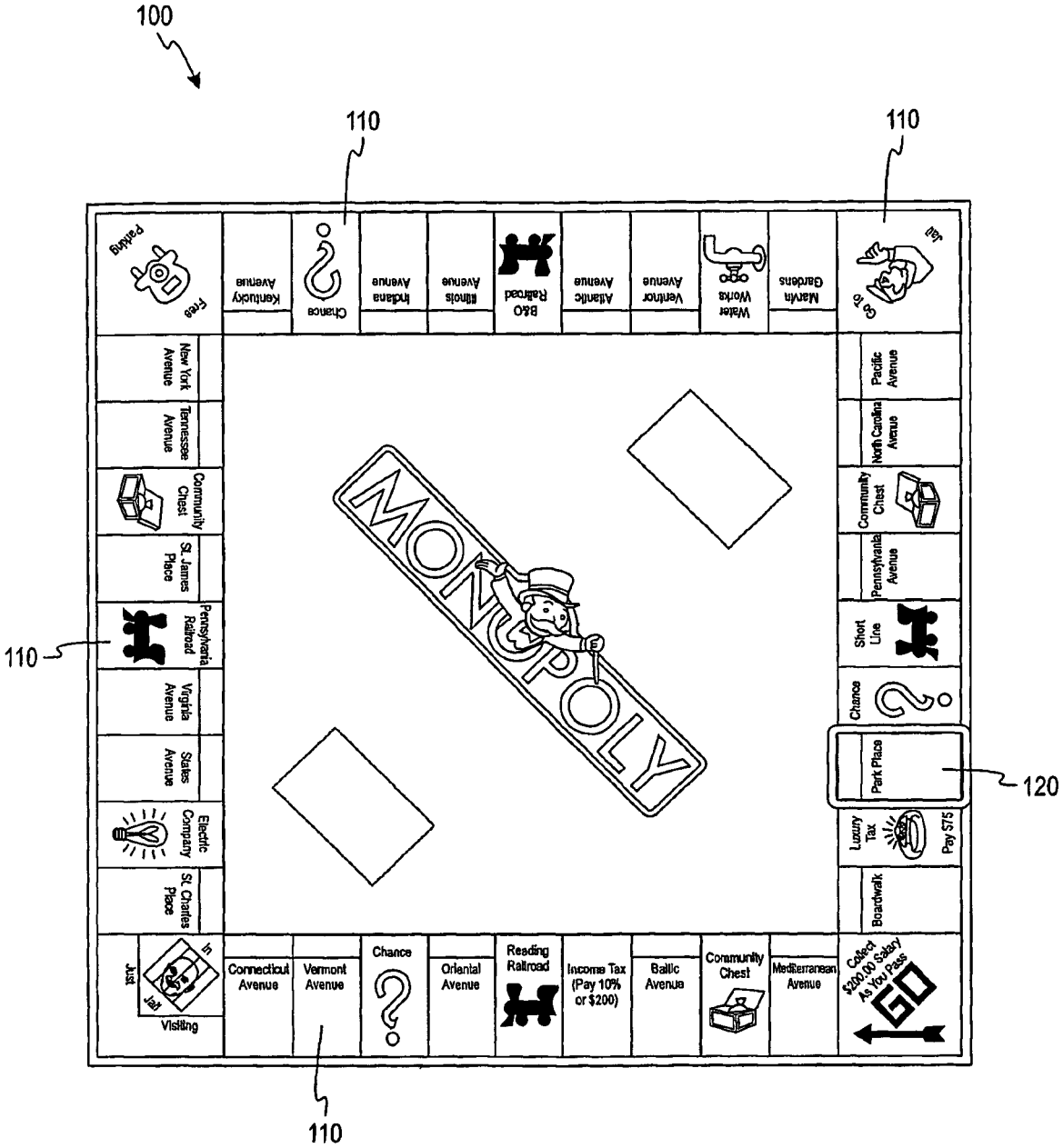
FIG. 17 is a representation of a screen display associated with a bonus game according to at least some aspects of the present concepts.

In yet another embodiment, the player selects the rental element(s), while the controller 34 selects the other elements 62. For example, the bonus feature may include a Monopoly™ board game of the type disclosed in U.S. Pat. No. 6,315,660, which is incorporated herein by reference in its entirety. The board game 100, such as is represented in FIG. 17, includes a plurality of spaces (or stations) 110 arranged in a square and including for example real estate properties, railroads, Community Chest, Chance, Free Parking, and such end-feature spaces as In Jail, Go To Jail, Luxury Tax, and Income Tax. In at least some aspects, another station 10 may be randomly selected for association with an end-feature outcome. A pair of dice determines movement of the token identifier around the board. At the commencement of the bonus feature, the player (or computer) may select a property 120 for the player to own and the player is provided an option to build houses or hotels on such properties. As shown in FIG. 17, the player (or computer) has selected as a "rental" property "PARK PLACE". In at least some other aspects, the player (or computer) may select more than one property 120 for the player to own and the player is provided an option to build houses or hotels on such properties. In still other aspects, at least one of the spaces 110 is associated with an outcome permitting the player to acquire another "rental" property. The selected "rental" property or properties 120 have a rental value based on the number of houses and hotels thereon. The rental value may, for example, be a credit amount.

To play the bonus feature, in at least some embodiments, the game (e.g., controller 34) or the player rolls the dice and the controller moves the token identifier around the board by a number of spaces 110 corresponding to the sum of the dice. If the token identifier lands on any space 110 except for an end-feature space, the player is provided with both the rental value of the selected "rental" properties 120 and an award (e.g., credit amount, multiplier, shield, bonus event, safe pick of another "rental" property, and/or any other benefit, singly or in combination, etc.) for the space landed upon. In at least some aspects, the player is provided with an option to own the space 110 landed upon, so that the player may accrue rent for that space as well in response to subsequent rolls of the dice. Ownership of said space 110, in at least some aspects, is had by outright purchase of the space, such as by a debiting of a total bonus amount or credit meter in correspondence to an assigned value of said space. The player or controller 34 continues to roll the dice, move the token identifier around the board 100, and provide the player with both the rental value of the selected "rental" properties 120 and an award for the space landed upon, until the token identifier lands on an end-feature space to end the bonus feature.

The player may be given the option to sell a rental property 120 for a lump sum value or hold onto the rental property to accrue rent. The lump sum value may, for example, be the expected return for holding onto the rental property 120. On the one hand, by selling the property 120 the player removes the risk that the game may end on a particular occasion before awarding the expected return. On the other hand, by holding onto the property 120 the player assumes this risk but also has the opportunity to exceed the expected return on a particular occasion. Thus, the player may choose the level of risk he or she is willing to take.

Each of these embodiments and obvious variations and combinations thereof is contemplated as falling within the spirit and scope of the claimed invention, which is set forth in the following claims.

The invention claimed is:

1. A method of conducting a wagering game on a gaming system, the gaming system including an input device, one or more display devices, and a controller having one or more processors, the method comprising: receiving a wager from a player, via the input device, to play the wagering game; initiating a bonus feature, via the controller, during the wagering game;

displaying, via the one or more display devices, a plurality of selectable elements, the plurality including a first selection set of elements and a second selection set of elements, wherein the first selection set does not include a bonus-ending element;

in response to a selection of a first selectable element from the first selection set, awarding the player a first credit amount associated with the first selectable element; and in response to one or more subsequent selections of other selectable elements having additional associated credit amounts, the selected other selectable elements being from the second selection set, awarding the player any additional credit amount associated with each selected other selectable element and re-awarding the player the first credit amount associated with the first selectable element for each selected other selectable element.

2. The method of claim 1, wherein the player selects the first selectable element.

3. The method of claim 1, wherein the player selects the one or more subsequently selected elements.

4. The method of claim 1, wherein the plurality of selectable elements includes a first selection set of selectable elements and a second selection set of selectable elements, the first selected element being in the first selection set of elements, the one or more subsequently selected elements being in the second selection set.

5. The method of claim 4, wherein all the selectable elements in the first selection set are associated with credit amounts or other beneficial outcomes, the method further comprising, in response to a subsequent selection of a selectable element from the second selection set associated with a safe pick symbol, awarding the player a selection of second selectable element from the first selection set, the second selectable element being associated with a second credit amount, and awarding the player both the first and second credit amounts for each subsequently selected other selected element from the second selection set that is not a bonus-ending item.

6. The method of claim 1, wherein the one or more subsequently selected elements are successively selected until the selection of a bonus-ending item.

7. The method of claim 6, further comprising:

displaying another plurality of selectable elements in response to the selection of a bonus-ending item; and associating a bonus saver outcome with at least one of the another plurality of selectable elements.

8. A gaming system for conducting a wagering game, the gaming system comprising:

at least one input device;

one or more display devices;

one or more processors; and at least one memory device storing instructions that, when executed by the one or more processors, cause the one or more processors to operate with the at least one input device and the one or more display devices to initiate the wagering game upon receiving a wager from a player;

display a plurality of selectable elements to the player;

designate a first selection set comprising at least one of the selectable elements from the plurality, and a second selection set containing at least some of the remaining selectable elements from the plurality, wherein the first selection set does not include a bonus-ending element;

in response to a selection of an element from the first selection set, award the player a first credit amount associated with the selected element from the first selection set; and in response to one or more subsequent selections of elements from the second selection set having additional associated credit amounts, award the player any additional credit amount associated each subsequent selection and re-award the player the first credit amount associated with the selected element from the first selection set for each of the one or more subsequent selections.

9. The system of claim 8, wherein all the elements in the first selection set are associated with credit amounts or other beneficial outcomes.

10. The system of claim 8, wherein the one or more subsequently selected elements are successively selected until the selection of a bonus-ending item.

11. The system of claim 9, further comprising, in response to a subsequent selection of an element from the second selection set associated with a safe pick symbol, awarding the player a selection of second element from the first selection set, the second element being associated with a second credit amount, and awarding the player both the first and second credit amounts for each subsequent selection from the second selection set that is not a bonus-ending item.

12. The system of claim 10, wherein the bonus-ending item triggers a display of another plurality of selectable elements, at least one selectable element in the another plurality of selectable elements being associated with a bonus saver outcome.

13. The system of claim 8, wherein at least one of the subsequently selected elements includes a shield element adapted to nullify a subsequent selection of a bonus-ending item.

14. The system of claim 8, wherein the player selects the element from the first selection set.

15. The system of claim 8, wherein the player selects the one or more elements from the second selection set.

16. The system of claim 8, wherein at least one of the elements in the second selection set is associated with an outcome that, in response to the selection of the at least one of the elements in the second selection set, enables another selection from the first selection set.

17. A method of conducting a wagering game on a gaming system, the method comprising:

receiving a wager from a player, via an input device, to play the wagering game;

displaying to the player, on one or more display devices, a plurality of selectable elements, the plurality including a first selection set of elements and a second selection set of elements, wherein the first selection set does not include a bonus-ending element;

in response to a selection of a first award-associated element from the plurality of selectable elements, awarding the player a first credit amount revealed by the selection of the first element; and in response to one or more subsequent selections of different award-associated elements, the selected different award-associated elements being from the second selection set, awarding the player any additional credit amount revealed by each subsequent selection and re-awarding the player the first credit amount revealed by the selection of the first element for each of the one or more subsequent selections.

18. The method of claim 17, wherein the subsequently selected elements are successively selected until the selection of a bonus-ending item.

19. The method of claim 18, further comprising associating at least one of the subsequently selected elements with at least one of a shield element and a multiplier element, the shield element being adapted to nullify the bonus-ending item and enable continued selection of the selectable elements in the second set.

20. The method of claim 17, wherein the first award-associated element is selected from a safe pick area comprising selectable elements associated with only credit amounts or other beneficial outcomes, the method further comprising, in response to a subsequent selection that reveals a safe pick symbol, awarding the player another selection of a selectable element from the safe pick area, the another selection revealing a second credit amount, and re-awarding the player both the first and second credit amounts for each further subsequent selection of an award-associated element.

* * * * *